US005711694A

United States Patent [19]

Levine et al.

[11] Patent Number: 5,711,694

[45] Date of Patent: Jan. 27, 1998

[54] FIELD EMISSION DEVICE WITH LATTICE VACANCY, POST-SUPPORTED GATE

[75] Inventors: Jules D. Levine, Dallas; Chi-Cheong Shen; Robert Taylor, both of Richardson, all of Tex.

[73] Assignee: Texas Instruments Incorporated, Dallas, Tex.

[21] Appl. No.: 670,468

[22] Filed: Jun. 26, 1996

Related U.S. Application Data

[62] Division of Ser. No. 453,043, May 30, 1995, Pat. No. 5,589,728.

[51] Int. Cl.[6] ..... H01J 1/30; H01J 9/18

[52] U.S. Cl. ..... 445/24; 445/49; 445/50

[58] Field of Search ..... 445/24, 50, 49

[56] References Cited

U.S. PATENT DOCUMENTS

| | | | |
|---|---|---|---|
| 3,998,678 | 12/1976 | Fukase et al. | 445/24 |
| 5,482,486 | 1/1996 | Vaudaine et al. | 445/50 |
| 5,507,676 | 4/1996 | Taylor | 445/24 |

*Primary Examiner*—P. Austin Bradley
*Assistant Examiner*—Jeffrey T. Knapp
*Attorney, Agent, or Firm*—Warren L. Franz; Wade James Brady, III; Richard L. Donaldson

[57] ABSTRACT

An electron emitter plate (110) for an FED image display has an extraction (gate) electrode (22) spaced by a dielectric insulating spacer (125) from a cathode electrode including a conductive mesh (18). Arrays (12) of microtips (14) are located in mesh spacings (16), within apertures (26) formed in clusters (23) in extraction electrode (22). Microtips (14) are deposited through the apertures (26). Apertures (26) are arranged in regular, periodic arrays (23, 23', 123, 123') defining lattices having occupied apertured positions and internal unapertured vacancy positions (150, 150'). The insulating spacer (125) is etched to undercut electrode (22) to connect apertured lattice positions, forming a common cavity (141) for microtips (14) within each mesh spacing (16), and leaving central posts (143) at the unapertured vacancies (150, 150'). The etch-out reduces the dielectric constant factor of gate-to-cathode capacitance in the finished structure. Placing posts at vacancy positions enables gate support over the cavity without sacrificing high microtip density.

8 Claims, 8 Drawing Sheets

FIELD EMISSION DEVICE WITH LATTICE VACANCY, POST-SUPPORTED GATE

This is a division of application Ser. No. 08/453,048, filed May 30, 1995, now U.S. Pat. No. 5,589,728.

TECHNICAL FIELD OF THE INVENTION

The present invention relates generally to electron emitting structures of the field emission type; and, in particular, to reduced cathode-to-gate capacitance arrangements for microtip emission cathode structures usable in FED field emission flat-panel image display devices.

BACKGROUND OF THE INVENTION

Examples of conventional electron emitting devices of the type to which the present invention relates are disclosed in U.S. Pat. Nos. 3,755,704; 3,812,559, 4,857,161; 4,940,916; 5,194,780 and 5,225,820. The disclosures of those patents are incorporated herein by reference.

A typical such structure, embodied as an electron emitter of an FED (field emission device) flat-panel image display device as described by Meyer in U.S. Pat. No. 5,194,780, is shown in FIGS. 1–5. Such device includes an electron emitter plate 10 spaced across a vacuum gap from an anode plate 11 (FIG. 1). Emitter plate 10 comprises a cathode electrode having a plurality of cellular arrays 12 of n×m electrically conductive microtips 14 formed on a resistive layer 15, within respective mesh spacings 16 (FIG. 2) of a conductive layer mesh structure 18 patterned in stripes 19 (referred to as "columns") (FIG. 5) on an upper surface of an electrically insulating (typically glass) substrate 20 overlaid with a thin silicon dioxide ($SiO_2$) film 21. An extraction (or gate) electrode 22 (FIGS. 1–3) comprises an electrically conductive layer of cross-stripes 24 (referred to as "rows") (FIG. 5) deposited on an insulating layer 25 which serves to insulate electrode 22 and space it from the resistive and conductive layers 15, 18. Microtips 14 are in the shape of cones which are formed within apertures 26 through conductive layer 22 and concentric cavities 41 of insulating layer 25. The microtips 14 are formed utilizing a variation of the self-alignment microtip formation technique described in U.S. Pat. No. 3,755,704, wherein apertures 26 and cavities 41 are etched after deposition of layers 22, 25 and wherein a respective microtip 14 is formed within each aperture 26 and cavity 41. The relative parameters of microtips 14, insulating layer 25 and conductive layer 22 are chosen to place the apex of each microtip 14 generally at the level of layer 22 (FIG. 1). Electrode 22 is patterned to form aperture islands or pads 27 centrally of the mesh spacings 16 in the vicinity of microtip arrays 12, and to remove cross-shaped areas 28 (FIG. 3) over the intersecting conductive strips which form the mesh structure of conductor 18. Bridging strips 29 of electrode 22 are left for electrically interconnecting pads 27 of the same row cross-stripe 24.

Anode plate 11 (FIG. 1) comprises an electrically conductive layer of material 31 deposited on a transparent insulating (typically glass) substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a phosphor coating 34, deposited over the conductive layer 31, so as to be directly facing and immediately adjacent extraction electrode 22.

In accordance with conventional teachings, groupings of the microtip cellular arrays 12 in mesh spacings 16 corresponding to a particular column-row image pixel location can be energized by applying a negative potential to a selected column stripe 19 (FIG. 5) of cathode mesh structure 18 relative to a selected row cross-stripe 24 of extraction electrode 22, via a voltage source 35, thereby inducing an electric field which draws electrons from the associated subpixel pluralities of n×m microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 31, completing the electrical circuit to voltage source 35.

The various column-row intersections of stripes 19 of cathode mesh structure 18 and cross-stripes 24 of extraction electrode 22 are matrix-addressed to provide sequential (typically, row-at-a-time) pixel illumination of corresponding phosphor areas, to develop an image viewable to a viewer 36 looking at the front or outside surface 37 of the plate 11. However, even with row-at-a-time addressing, the per pixel addressing duty factor is small. For example, the pixel dwell time (fraction of frame time available to excite each pixel) for row-at-a-time addressing in a 640×480 pixel color display refreshed at 60 frames per second (180 RGB color fields per second), is only about 8–10 microseconds per row. This means that for pulsewidth modulated gray scale control, where the dwell time per pixel is further divided into as many as 64 dwell time subintervals, column voltage switching during row "on" times occurs at the rate of about once every 30–40 nanoseconds. At such high switching rates, total gate-to-cathode capacitance for the column stripes 19 becomes a significant factor in the RC time constant and has a predominant adverse influence on the $\frac{1}{2}CV^2$ power consumption factor. Some reduction in capacitance is achieved through the described patterning of gate electrode 22, wherein removal of gate electrode from areas 28 reduces capacitance away from the microtips. There remains, however, a pressing need to reduce the column gate-to-cathode capacitance even more in such field effect devices.

Spindt, et al., U.S. Pat. No. 3,812,559 (see FIG. 9 of the '559 patent) illustrates a conventional microtip emission cathode structure wherein a gate electrode is supported only at its periphery. This reduces gate-to-cathode capacitance due to the elimination of most of the gate-supporting dielectric material present in structures such as that of Meyer '780, which have insulating material 25 completely surrounding each microtip 14. The '559 structure has no supports except at the periphery of the entire gate electrode and has the advantage of reducing capacitance especially for high frequency (viz. microwave frequency) operations wherein gate-to-cathode capacitance has particularly adverse consequences. The Spindt '559 structure is, however, subject to several problems. First, except for very small structures, the lack of any support except at the periphery can lead to excess bouncing or vibration of the gate electrode, similar to vibrations encountered by a peripherally supported membrane. This so-called "trampoline" effect can lead to structure failure and undesirable variations of gate-to-cathode current flow. The large unsupported central region is also subject to other problems. In assembly of a display structure, glass balls or other spacers acting between the anode and cathode plates may cause unwanted physical deformation and even destruction of an unsupported gate. Also, during fabrication, surface tension of etching liquids used in wet etching steps (such as for removal of a sacrificial Ni layer) can cause the unsupported structure to break when the liquids are recovered. The unsupported gate region may also be subject to distortion due to electrical attraction between the positively charged gate and the negatively charged cathode.

SUMMARY OF THE INVENTION

The present invention provides an electron emitting structure of the field emission type having reduced cathode-to-gate capacitance. In particular, the invention provides a thin-film microtip emission cathode structure with reduced column cathode-to-gate dielectric constant, achieved through reduction in the mass of the insulating layer that serves to space cathode and gate electrode layers.

In accordance with embodiments of the invention, described further below, a field emission cathode structure formed using a self-aligning microtip fabrication process is given an exaggerated undercut etching, either during or after formation of the gate electrode apertures, thereby reducing the amount of insulating spacer material between aperture pads of the gate electrode and associated microtip cellular arrays of the cathode electrode. In illustrated embodiments, aperture clusters are arranged in regular, periodic arrays defining lattices with selected vacancy points from which apertures are omitted. Etching is controlled so that microtips associated with each aperture lattice cluster will be formed within a common cavity, leaving unetched posts at the lattice vacancy positions. Pads patterned in the gate electrode are located centrally over the cathode mesh spacings, supported peripherally on cavity outer walls and centrally on the lattice vacancy posts.

By eliminating portions of the insulating spacer material between the cathode mesh spacings and the gate pads, the average dielectric constant between the cathode and gate electrodes for each column is significantly reduced, thereby leading to an overall reduction in column cathode-to-gate capacitance. This reduces the RC time constant and the total power consumption of the resulting matrix-addressed pixel image. Supporting the pads on posts alleviates the problems of trampolining and other deformations previously described. Forming the aperture clusters with vacancies in regular, periodic lattice arrays enables the posts to be readily produced at selected locations, without the need for additional processing steps. Placing the posts at vacancies is especially advantageous for achieving otherwise dense packing of microtips within the arrays.

BRIEF DESCRIPTION OF THE DRAWINGS

Embodiments of the invention have been chosen for the purpose of illustration and description, and are shown with reference to the accompanying drawings, wherein:

FIG. 1 is a view of the display corresponding to a section taken along the line 1—1 of FIGS. 2 and 4;

FIG. 2 is a top plan view of a portion of a pixel of the image forming area of the cathode plate of the display;

FIG. 3 is a view of the cathode plate laterally displaced from that of FIG. 1, corresponding to a section taken along the line 3—3 of FIGS. 2 and 4;

FIG. 4 is an enlarged top plan view, with gate electrode layer removed, of a central region of one subpixel mesh spacing of the display; and FIG. 5 is a schematic macroscopic top view of a corner of the cathode plate useful in understanding the row-column, pixel-establishing intersecting relationships between the cathode grid and pad-patterned gate electrodes shown in greater enlargement in FIG. 2.

FIGS. 6 and 7 are section views, taken along the lines 6—6 and 7—7 of FIGS. 8 and 9 and respectively corresponding to the views of FIGS. 1 and 3, of a display incorporating an electron emitting structure in accordance with the invention;

FIGS. 8 and 9 are identical views corresponding to that of FIG. 3, except that the gate electrode layer is shown in FIG. 8;

FIGS. 10A–10D are schematic views showing exemplary alternative lattice arrangements of the gate layer aperture clusters; and FIGS. 11A–11F are schematic views showing steps in a method of fabrication of the structure of FIGS. 6–9.

Throughout the drawings, like elements are referred to by like numerals.

DETAILED DESCRIPTION OF PREFERRED EMBODIMENTS

Figure 1:
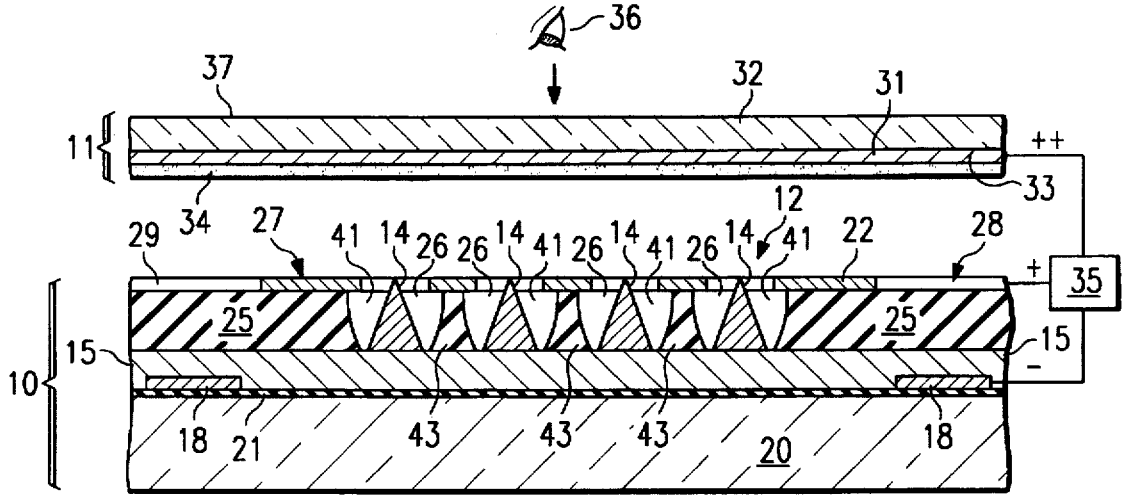
FIG. 1 (PRIOR ART)
FIGS. 1–5, already described and relating to the prior art, illustrate a typical "subpixel mesh" electron emitting structure fabricated utilizing conventional thin-film deposition techniques, and embodied in an FED flat-panel image display device.
Figure 2:
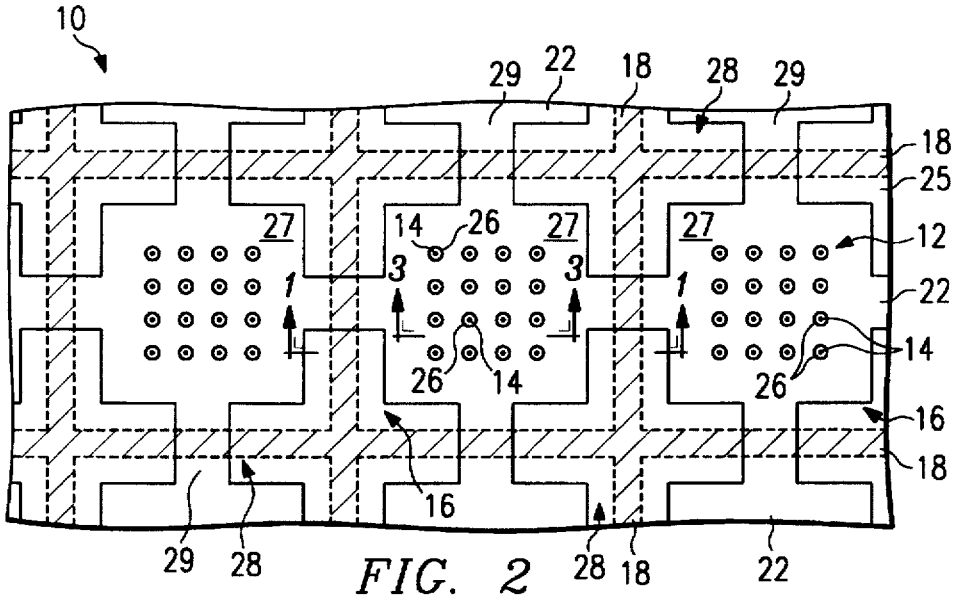
FIG. 2 (PRIOR ART)

FIGS. 6–9 illustrate an embodiment of an FED flat-panel image display device, incorporating an electron emitter plate 110 fabricated in accordance with the teachings of the present invention.

As with the device of FIGS. 1–5, the emitter plate 110 is spaced across a vacuum gap from an anode plate 11, which may be identical to the anode plate 11 previously described. Likewise, in conformance with the previously described emitter plate 10, emitter plate 110 generally comprises a cathode electrode having a plurality of clusters 12 of similar electrically conductive microtips 14 formed in cellular arrays on a resistive layer 15, within respective mesh spacings 16 (see FIGS. 8 and 9) of a conductive layer mesh structure 18 patterned in column stripes 19 (see FIG. 5) on an upper surface of a glass or other substrate 20 overlaid with a thin silicon dioxide ($SiO_2$) film 21. Also, in conformance with the previously described emitter plate 10, the illustrated emitter plate 110 may have an extraction (or gate) electrode 22, patterned to form aperture islands or pads 27, each having a cluster 23 of apertures 26 arranged in one-to-one correspondence with the microtips 14 and located centrally over a respective cathode electrode mesh spacing 16. The extraction electrode 22 comprises an electrically conductive layer of row-defining cross-stripes 24 (see FIG. 5) that run transversely to the stripes 19 defined by the cathode electrode mesh structure 18.

Figure 3:
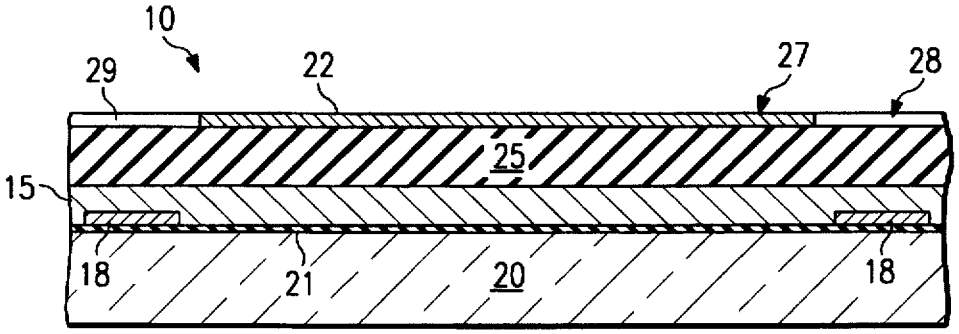
FIG. 3 (PRIOR ART)
Figure 4:
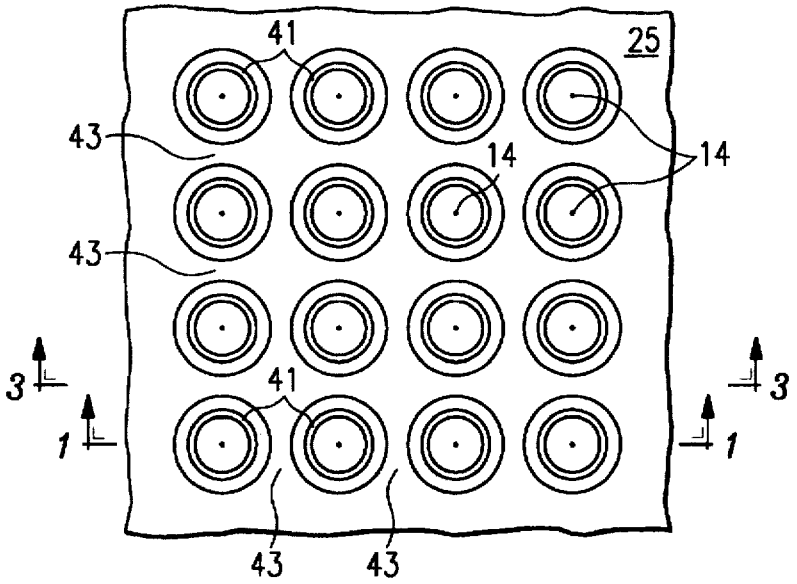
FIG. 4 (PRIOR ART)
Figure 5:
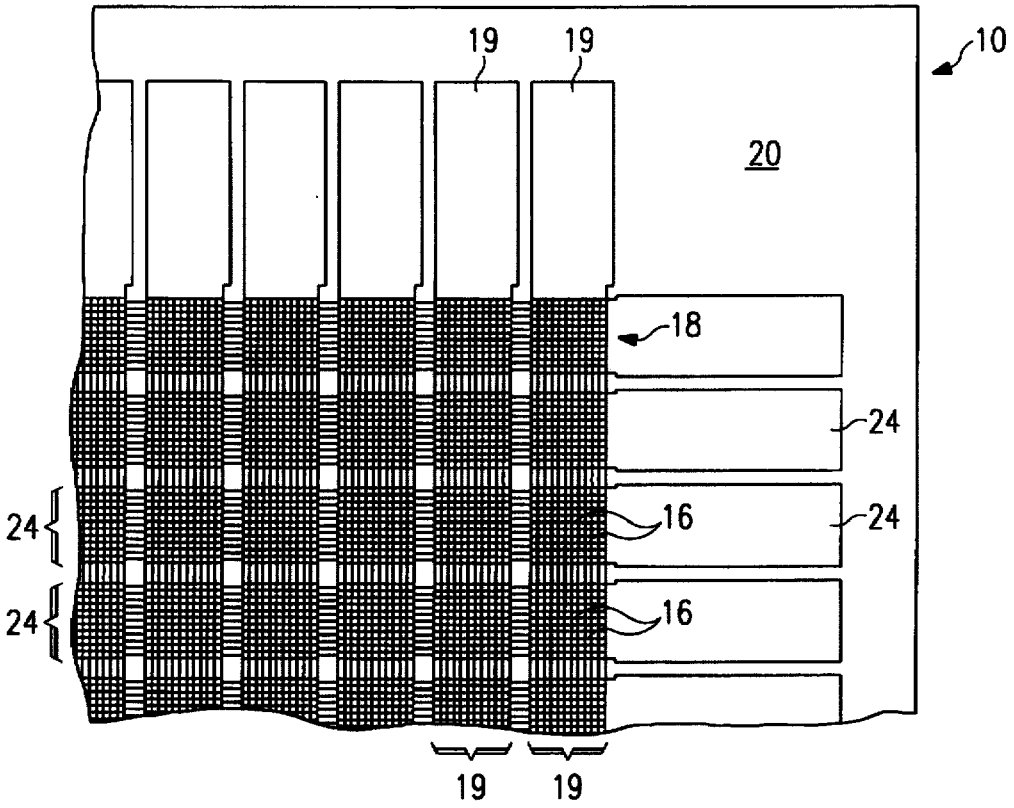
FIG. 5 (PRIOR ART)
Figure 6:
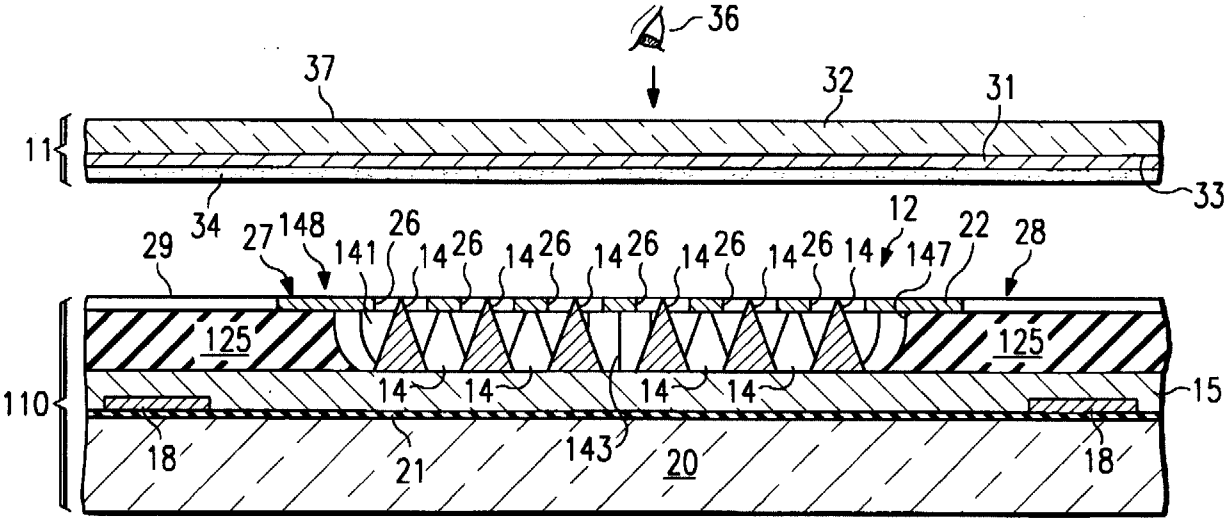
FIGS. 6–9, 10A–10D and 11A–11F illustrate embodiments of the invention.
Figure 7:
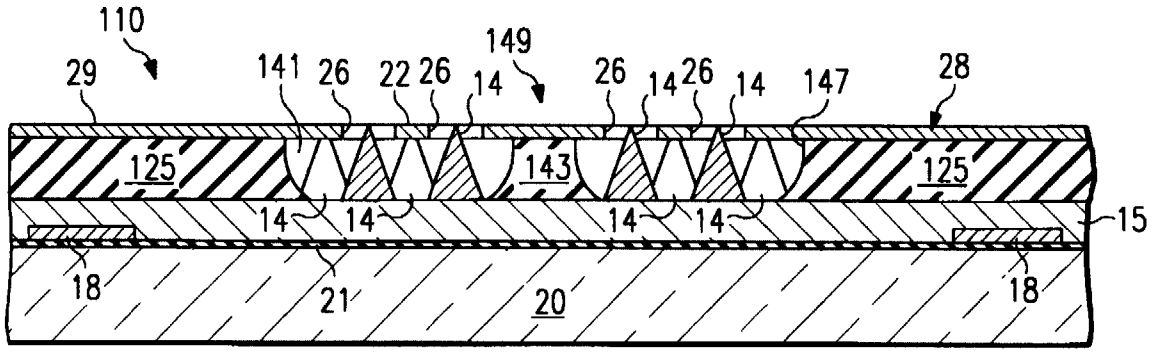
Figure 8:
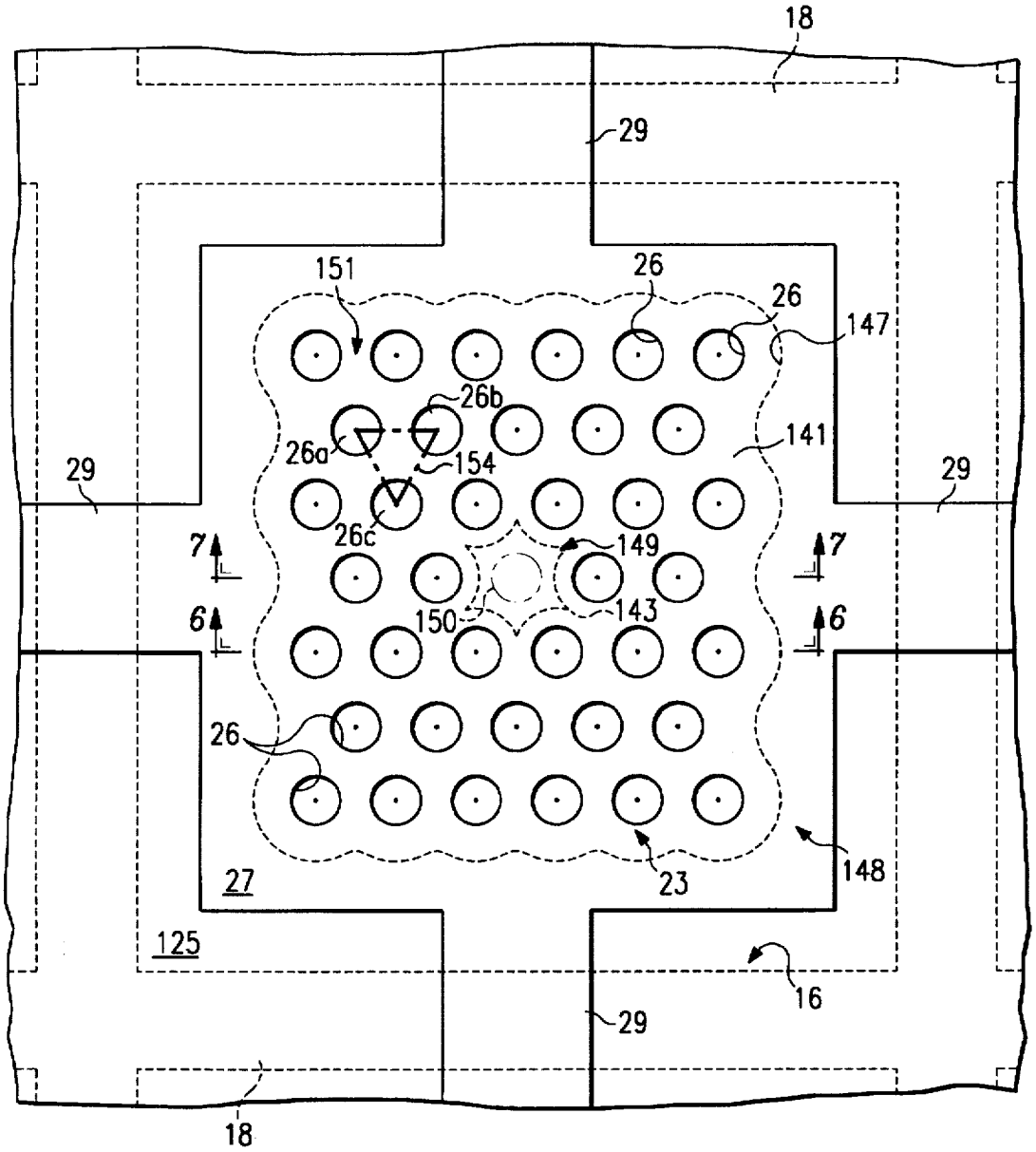
Figure 9:
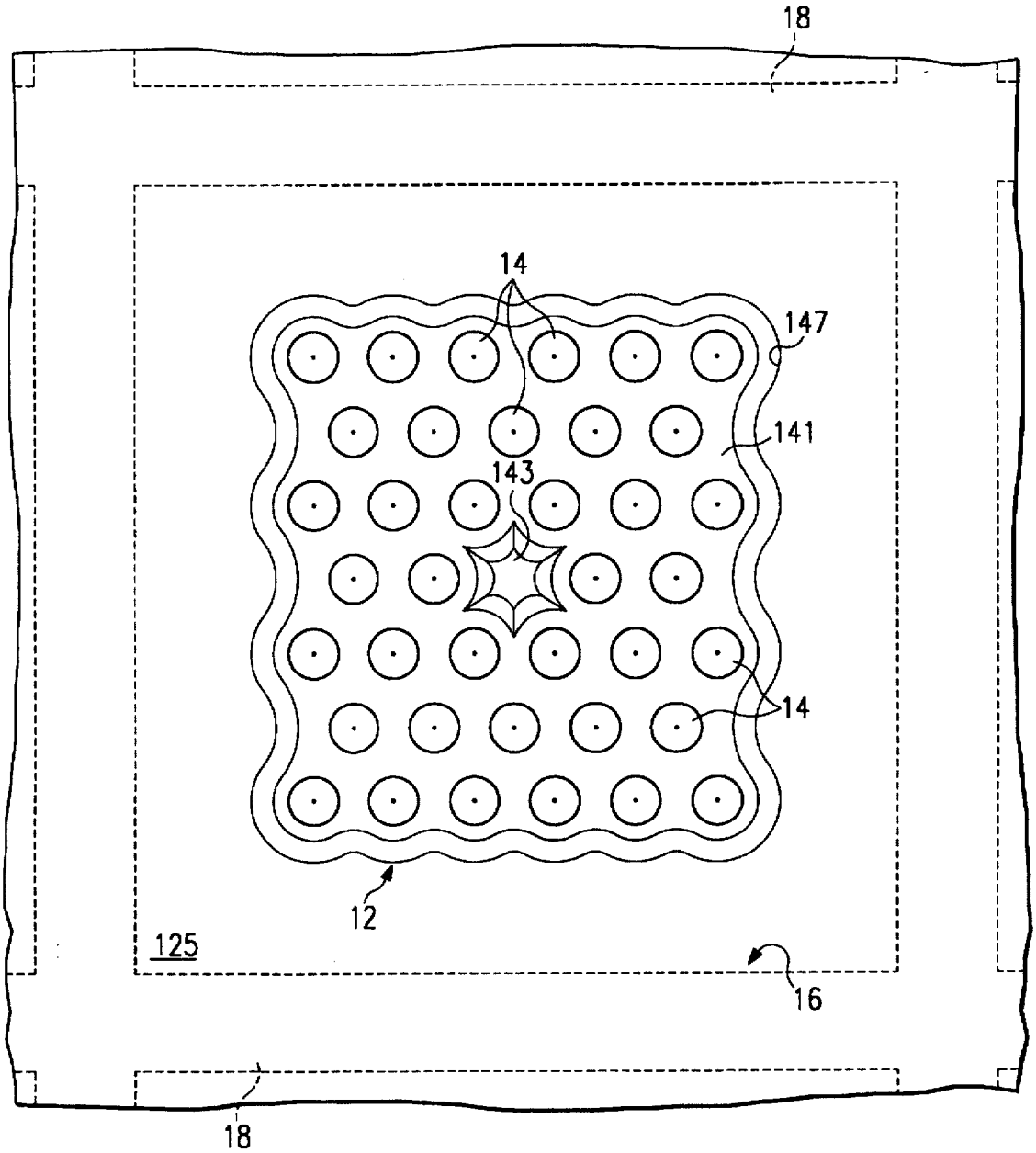

Conductive layer 22 is spaced and insulated from resistive layer 15 and cathode mesh structure 18 by an intervening dielectric insulating layer 125 which corresponds to the layer 25 shown in FIGS. 1, 3 and 4. Unlike layer 25 however, layer 125 does not have discrete isolated cavities 41, formed concentrically about the site of each microtip 14, leaving unbroken partitions 43 separating adjacent ones of the cavities 41 of the microtips 14 of the same cluster 12 (see FIGS. 1 and 4). Instead, the mass of insulating layer 125 has been reduced to remove partitions 43 and provide microtips 14 of each cluster 12 commonly located in a shared larger cavity 141. As shown in FIG. 8, each cluster 23 of apertures 26 is arranged in a regular, periodic array defining a two-dimensional lattice, having an aperture 26 located at each "occupied" lattice position and having an unapertured region 149 located at an internal lattice vacancy 150 (i.e. position indicated by dot-dashed lines in FIG. 8 which would otherwise be occupied by an aperture). Likewise, as shown in FIG. 9, the microtips 14 of each microtip cluster 12, which are in one-to-one correspondence with the apertures 26 of each cluster 23, are also arranged in a regular, periodic array defining a like two-dimensional lattice, with a microtip 14 located at each occupied lattice position and an internal pillar or post 143 of insulating material 125 located at the vacancy. This reduction in mass of material 125 centrally of the mesh spacings 16 (see FIGS. 6–9) positions the microtips 14 of each array 12 within a single, common main cavity 141 formed centrally within each mesh spacing 16. The gate electrode layer 22 is supported peripherally, marginally of each pad 27 on insulative material 125 (see FIG. 8) bordering the perimeter of cavity 141, on a boundary wall 147 defining the lateral extremities of cavity 141 of each array 12. The portion 148 of layer 22 that defines the marginal edge of each pad 27 is supported on boundary wall 147 (see FIGS. 6 and 8). The portion 151 of layer 22 that defines the central part of each pad 27 that extends over the top of cavity 141, is supported on the posts 143 which are left at the vacancies 150 when the partitions 43 are eliminated from the occupied lattice positions.

The size of apertures 26 in the arrangement of FIGS. 6–9 can be the same as the size of apertures 26 in the arrangement of FIGS. 1–4, and similar self-alignment techniques can be used to obtain initial alignment for forming microtips 14 in general concentric alignment within apertures 26. Beyond this, however, the removal of dielectric from below the apertures 26 is increased above that utilized to obtain the prior art cavities 41. The traditional size of cavities 41 is expanded at occupied lattice points to the point where their diameters overlap and the partitions 43 are eliminated at least partially, and preferably completely.

Capacitance of the cathode plate structure 10 or 110 is proportional to the area and spacing of the separated conductive layers 18, 22 and to the magnitude of the dielectric constant of the material (viz. insulating layer 25 or 125) separating layers 18, 22. An electron emitting structure in accordance with the invention, as illustrated by the described cathode plate 110, has overall reduced capacitance because of reduced average dielectric constant resulting from elimination of insulating layer material (compare layer 125 with layer 25) and replacement of the same with the significantly lower dielectric constant of air (viz. vacuum), especially in the vicinity of highest electron concentration (viz. the microtip arrays 12, centrally of the mesh spacings 16). Accordingly, an image display device incorporating the principles of the invention exhibits a lower RC time constant and reduced $\frac{1}{2}CV^2$ power dissipation.

For the particular embodiment illustrated in FIGS. 6–9, apertures 26 are formed in a staggered two-dimensional lattice array, having row-adjacent apertures **26*a* and 26*b* (FIG. 8) and column-adjacent apertures 26*a* and 26*c* (FIG. 8) spaced by the same generally even spacing. The apertures 26 are thus arranged in a close-packed hexagonal lattice configuration, wherein lines drawn between closest row-adjacent and column-adjacent apertures 26*a*, 26*b*, 26*c* form equilateral triangles 154 (see dot-dashed lines in FIG. 8). A single vacancy 150 is left in the center of the lattice, providing a single central support post 143. Except for the vacancy post 143, all partitions 43 (see FIG. 4) are eliminated. This arrangement significantly reduces the dielectric material 25 in the active emission area, thereby ameliorating the gate-to-cathode capacitance problem, and provides good central support to the pads 27** while sacrificing little, if any, microtip density.

Figure 10A:
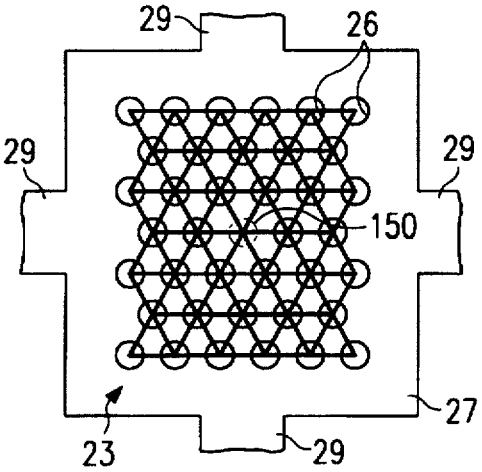
Figure 10B:
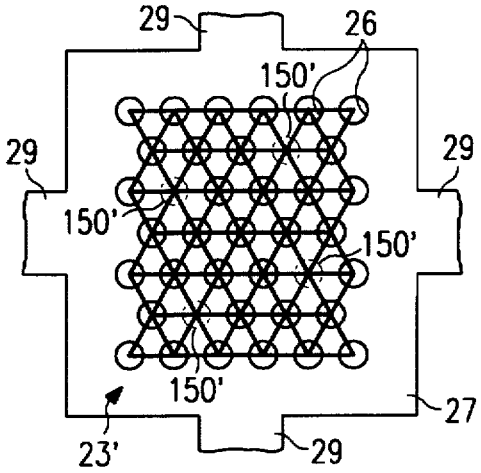
Figure 10C:
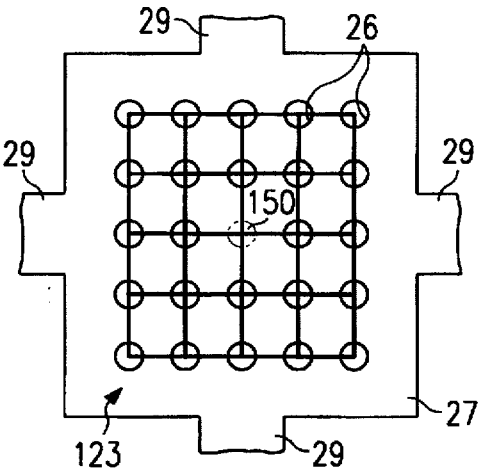
Figure 10D:
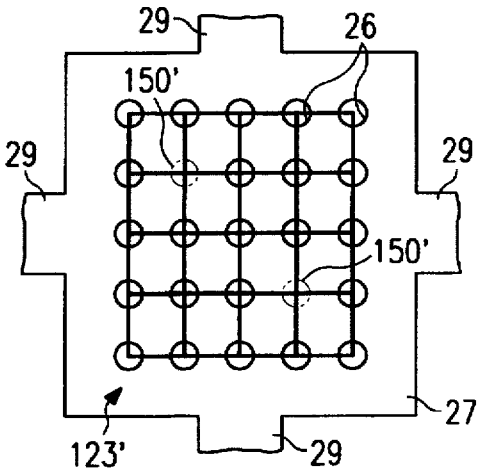

FIGS. 10A–10B are schematic views illustrating variations implementations of lattice patterns usable for electron emitter plates in accordance with the principles of the invention. The same lattice pattern can be reproduced by means of a stepper or the like onto all pads 27. FIG. 10A shows, for comparison purposes, the same close-packed hexagonal lattice array 23 described above in reference to FIGS. 6–9. The corresponding microtip array 12 will be located in a cavity 141 having a single internal post 143 in its center. FIG. 10B shows a modification 23' of the close-packed hexagonal lattice 23, having four vacancies 150' spaced internally throughout the lattice. The corresponding microtip array cavity will, accordingly, have four posts 143 located respectively below the vacancies 150'. FIG. 10C shows an alternative embodiment of an aperture array 123, wherein apertures 26 are arranged in a rectangular matrix lattice with lines joining neighboring lattice points forming squares, and with a single vacancy 150 located at the center of the lattice. In this case, the underlying microtip array will be in a cavity with a single post, as with the arrangement of FIG. 10A. FIG. 10D shows a modification 123' of the arrangement 123, having two vacancies 150' located internally, off-center in the lattice. And, as with the arrangement of FIG. 10B, posts will be located under each vacancy 150' in the underlying microtip cavity.

A conventional process for fabrication of thin-film microtip emission cathode structures of the type described with reference to FIGS. 1–5 is generally described in Spindt U.S. Pat. No. 3,755,704 and Meyer U.S. Pat. No. 5,194,780. Such process can be modified in accordance with illustrative embodiments of methods of the invention to fabricate the structures in accordance with the invention.

Figure 11A:
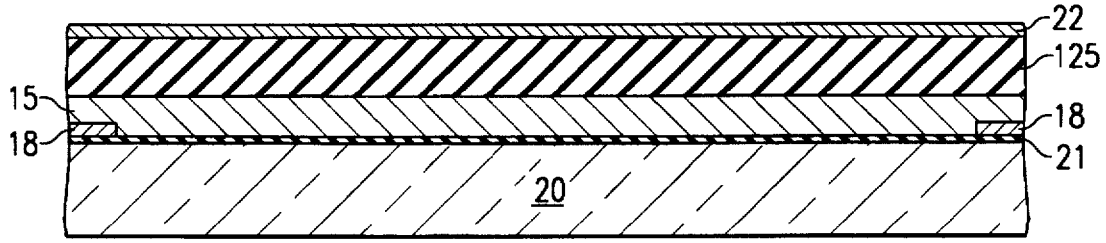

As shown in FIG. 11A (corresponding to the view of FIG. 7), a cathode mesh structure 18, resistive layer 15, insulating layer 125 and gate electrode layer 22 are successively formed on an upper surface of a glass substrate 20, which has been previously overlaid with a thin layer 21 of silicon dioxide ($SiO_2$) of about 500–1000 Å thickness. The cathode structure 18 may, for example, be formed by depositing a thin coating of conductive material, such as niobium of about 2,000 Å thickness, over the silicon dioxide layer 21. The mesh pattern of structure 18 and connectors defining the columns 19 may then be produced in the conductive coating by photolithography and etching to give, e.g., mesh-defining strips of 2–3 micron widths, providing 25–30 micron generally square mesh spacings 16, at 11×10 mesh spacings per 300 micron pixel, with column-to-column separations of 50 microns (see FIG. 5). Resistive layer 15 may, for example, be formed as a resistive, undoped silicon coating of, e.g., 10,000–12,000 Å thickness, deposited by cathode sputtering or chemical vapor deposition over the patterned mesh structure 18 and mesh spacings 16 (see FIG. 2). Spacer layer 125 may, for example, be formed as a silicon dioxide ($SiO_2$) layer of 1.0–1.2 micron thickness deposited by chemical vapor deposition over the resistive coating 15. Gate electrode layer 22 may, for example, be formed by depositing a thin metal coating of niobium with, e.g., 2,000 Å thickness over the spacer layer 125.

Figure 11B:
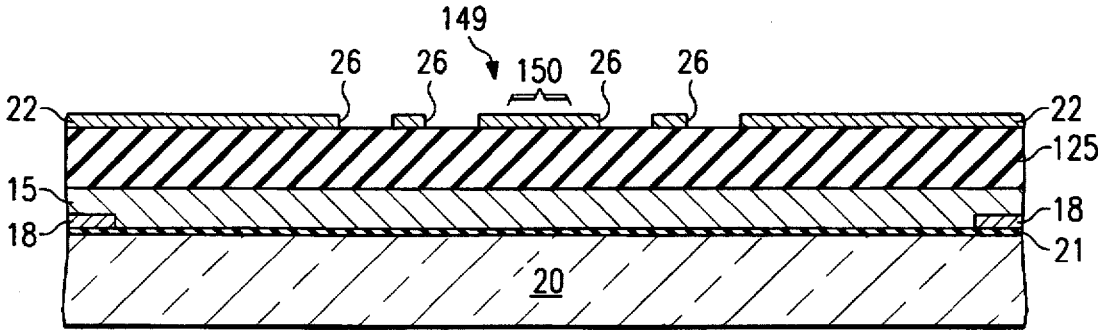
Figure 11C:
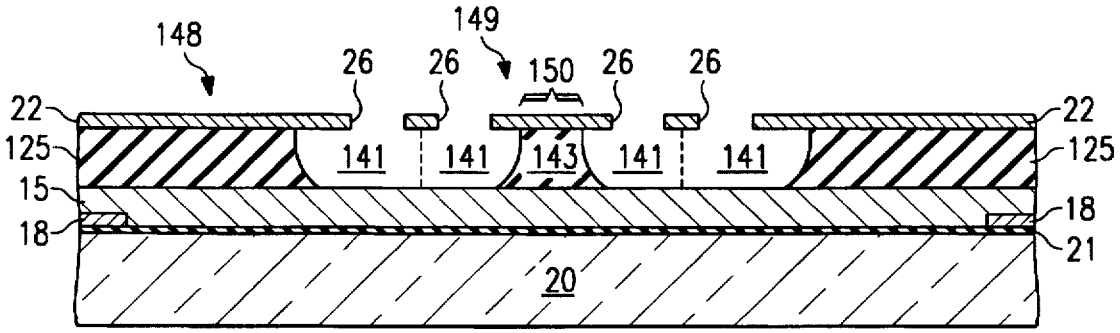

Next, as shown in FIG. 11B, gate layer 22 is masked and etched to define pluralities of apertures 26 of 1.0–1.4 micron diameters arranged in regular, periodic arrays at, for example, 25 micron array pitches. The arrays define lattices having an internal vacancy 150 describing unapertured regions 149. The insulating layer 125 is then subjected to a first dry etching to form pluralities of arrays of discrete cavities in respective concentric alignments with and located beneath the apertures 26. Layer 125 may then be subjected to a wet etch (see FIG. 11C) to undercut the gate layer away from the apertures to remove the partitions 43 (see FIG. 1) between apertures 26 and form a cavity 141. The bases of partitions 43 can be left, and the wet etching stopped as soon as the tops of the partitions become spaced from the gate layer 22, if desired. Otherwise, as indicated, the etch is continued until the partitions 43 are almost totally eliminated. The etch proceeds generally radially outwardly of the apertures 26. Thus, when the partitions 43 are gone and the etch stopped, a central post 143 will be left under the unapertured region 149, as all etching of the insulating layer below that region proceeds from the neighboring "occupied" lattice point apertures.

Figure 11D:
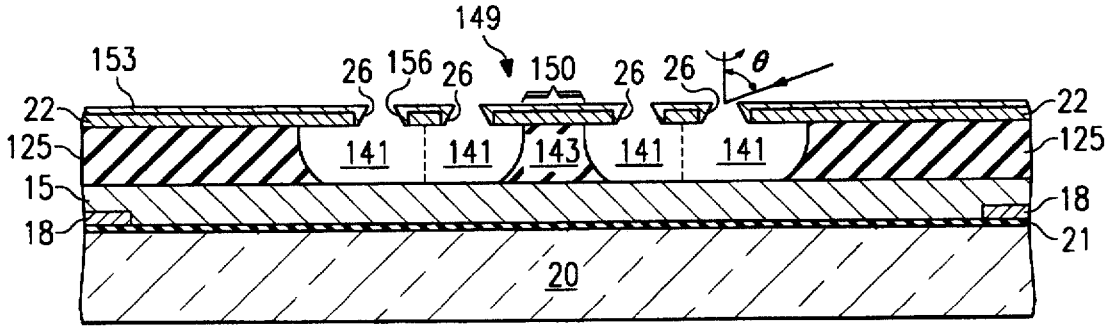
Figure 11E:
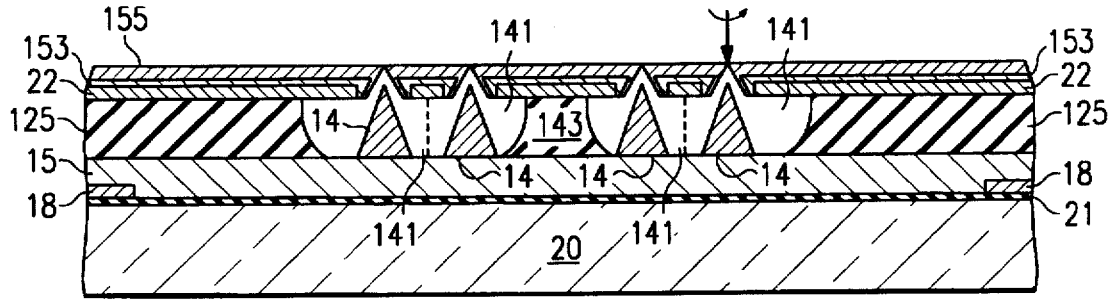
Figure 11F:
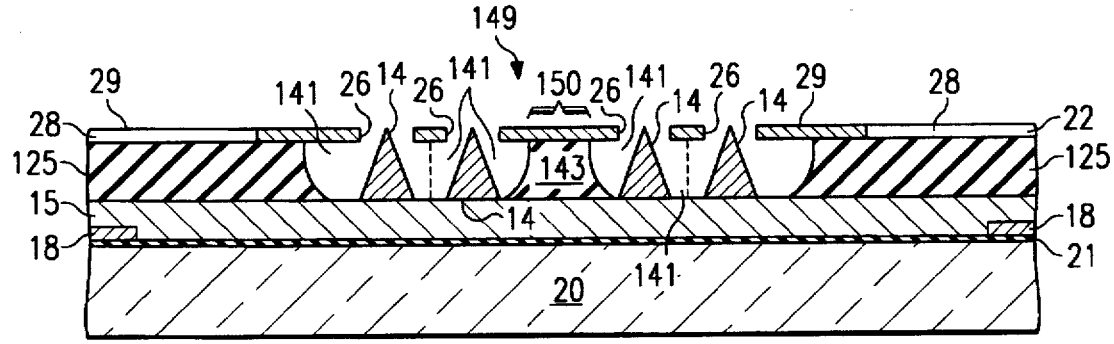

Thereafter, as shown in FIG. 11D, while rotating the substrate 20, a sacrificial lift-off layer 153 of, e.g., nickel is formed by electron beam deposition over the layer 22. The beam is directed at an angle of 5°–20° to the surface (70°–85° from normal) so as to deposit lift-off layer material on the aperture circumferential walls at 156. Then, as shown in FIG. 11E, with substrate 20 again being rotated, molybdenum and/or other conductive tip forming material is deposited on the inner surface of cavity 141 by directing a beam substantially normal to the apertures 26 to form pluralities of arrays of microtips 14, self-aligned in respective concentric alignment within the apertures 26 and cavity 141. Lastly, as shown in FIG. 11F, superfluous molybdenum deposition 155 deposited over the nickel layer 153 is removed, together with the nickel layer 153. Subsequent masking and etching is used to pattern the apertured layer 22, to define the row cross-stripes 24 (see FIG. 5), the pads 27 and the bridging strips 29 (see FIGS. 3 and 11 F). Row cross-stripes 24 may, for example, be formed with widths of 300–400 microns and spacings of 50 microns. Pads 27 may be formed as nominal 15 micron squares centered at 25 micron pitches over mesh spacings 16 and with bridging strips 29 of 2–4 micron widths.

In the illustrated embodiments, the cathode current flows to the microtips 14 through the conductive layer 18 and resistive layer 15. The ordering of the layers 15 and 18 may be reversed. Likewise, if desired, the microtips 14 of each subpixel array may be placed on or over a conductive plate located within each mesh spacing 16, spaced from the mesh structure strips. Other arrays of aperture clusters 23 and microtip clusters 12 are also possible. Moreover, a mesh may be formed in the gate electrode layer 22 either instead of, or in addition to, forming the mesh in the conductive layer 18. Those skilled in the art to which the invention relates will appreciate that yet other substitutions and modifications can be made to the described embodiments, without departing from the spirit and scope of the invention as defined by the claims below.

What is claimed is:

1. A method of fabricating an electron emitter plate, comprising the steps of:

depositing a first layer of conductive material on a substrate;

depositing a layer of insulating material over said first layer of conductive material;

depositing a second layer of conductive material over said layer of insulating material;

forming a plurality of apertures in said second layer of conductive material; said apertures being arranged in a regular, periodic array defining a lattice having at least one internal vacancy;

etching said layer of insulating material through said apertures to form a cavity having a boundary encompassing said apertures, leaving unetched portions of said insulating material within said cavity to form a post under said at least one lattice vacancy; and depositing conductive material through said apertures to form a microtip in each aperture in electrical communication with said first layer of conductive material.

2. The method of claim 1, further comprising the step of patterning a mesh structure in said first layer of conductive material; said mesh structure defining a mesh spacing; and said apertures being located within said mesh spacing.

3. The method of claim 2, further comprising the step of patterning said second layer of conductive material to define a pad located centrally within said mesh spacing, and at least one bridging strip electrically connecting said pad to the remainder of said layer of conductive material; said apertures being formed on said pad and said insulating layer being etched so that said cavity boundary supports said pad marginally and said post supports said pad centrally.

4. The method of claim 3, further comprising the steps of patterning the first layer of conductive material to form stripes; and patterning the second layer of conductive material to form cross-stripes which intersect said stripes at pixel-defining locations.

5. The method of claim 4, wherein said apertures are formed with said at least one vacancy located at the center of said lattice, and wherein said insulating layer is etched to leave a central post under said vacancy.

6. A method of fabricating an electron emitter plate, comprising the steps of:

depositing a first layer of conductive material on a substrate;

patterning a mesh structure in said first layer of conductive material; said mesh structure defining a plurality of mesh spacings;

depositing a layer of insulating material over said first layer of conductive material and said mesh spacings;

depositing a second layer of conductive material over said layer of insulating material;

forming a cluster of apertures within each mesh spacing in said second layer of conductive material; the apertures of each cluster being arranged in a regular, periodic array defining a lattice having at least one internal vacancy;

etching said layer of insulating material through said apertures to form a cavity within each mesh spacing; said cavity having a boundary encompassing said apertures of the associated cluster, leaving unetched portions of said insulating material within said cavity to form a post under said at least one lattice vacancy; and depositing conductive material through said apertures to form a microtip in each aperture in electrical communication with said first layer of conductive material.

7. The method of claim 6, further comprising the step of patterning said second layer of conductive material to form pads respectively located centrally within said mesh spacings, and at least one bridging strip electrically connecting each pad to the remainder of said layer of conductive material; said aperture clusters being respectively formed on said pads and said insulating layer being etched so that said cavity boundaries support said pads marginally and said posts support said pads centrally.

8. The method of claim 7, further comprising the steps of patterning the first layer of conductive material to form stripes; and patterning the second layer of conductive material to form cross-stripes which intersect said stripes at pixel-defining locations.

* * * * *